US005329890A

United States Patent [19]

Mueller

[11] Patent Number: 5,329,890

[45] Date of Patent: Jul. 19, 1994

[54] HYDRAULIC CONTROL DEVICE

[75] Inventor: Martin Mueller, Moeglingen, Fed. Rep. of Germany

[73] Assignee: Robert Bosch GmbH, Stuttgart, Fed. Rep. of Germany

[21] Appl. No.: 74,822

[22] PCT Filed: Sep. 4, 1992

[86] PCT No.: PCT/DE92/00748

§ 371 Date: Jun. 7, 1993

§ 102(e) Date: Jun. 7, 1993

[87] PCT Pub. No.: WO93/08379

PCT Pub. Date: Apr. 29, 1993

[30] Foreign Application Priority Data

Oct. 26, 1991 [DE] Fed. Rep. of Germany ..... 4135380

[51] Int. Cl.[5] ..... F01L 1/34

[52] U.S. Cl. ..... 123/90.17; 123/90.31; 464/2; 74/568 R

[58] Field of Search ..... 123/90.15, 90.17, 90.31; 464/2; 74/567, 568 R

[56] References Cited

U.S. PATENT DOCUMENTS 5,167,206 12/1992 Suga ..... 123/90.17
5,189,999 3/1993 Thoma ..... 123/90.17
5,247,914 9/1993 Imai et al. ..... 123/90.17

FOREIGN PATENT DOCUMENTS 3247916 6/1984 Fed. Rep. of Germany .
3929621 3/1991 Fed. Rep. of Germany .
2657648 8/1991 France .

*Primary Examiner*—Noah P. Kamen
*Assistant Examiner*—Weilun Lo
*Attorney, Agent, or Firm*—Michael J. Striker

[57] ABSTRACT

A hydraulic control device for the rotation of the camshaft of an internal combustion engine has a sprocket wheel which is driven by the internal combustion engine and connected with the camshaft via a couple member, a spiral toothing and a straight toothing, so that a relative rotation of the drive wheel and camshaft is effected by displacement of the couple member. The couple member is displaced via a hydraulic piston which is acted upon by a radial piston pump arranged in the control device, sucking pressure medium out of a pressure medium reservoir arranged in the engine, and feeding it to the pressure spaces at the piston via outlet valves. A pressure control valve which can be acted upon electromagnetically is connected to one of the pressure spaces and can be opened by corresponding actuation of the electromagnet so that the pressure space at the piston is relieved.

8 Claims, 2 Drawing Sheets

HYDRAULIC CONTROL DEVICE

BACKGROUND OF THE INVENTION

The present invention relates to a hydraulic control device for rotation of a camshaft of an internal combustion engine.

More particularly, it relates to such hydraulic control device which has a couple member longitudinally displaceable under the action of pressure and having a toothing engaging with a toothing of a cam shaft and supported by a sprocket wheel driven by an internal combustion engine with a central hole having a toothing engaging a toothing at another location of the couple member, with a piston acted upon by pressure medium delivered by a pump via an electromagnetic valve. In such a known control device in particular the pump and the electromagnetic valve are arranged externally, which is relatively complicated, particularly in view of the necessary pressure-medium connections, but also brings about considerable construction costs (DE-OS 32 47 916).

SUMMARY OF THE INVENTION

Accordingly, it is an object of the present invention to provide a hydraulic control device for rotation of a cam shaft of an internal combustion engine, which avoids the disadvantages of the prior art.

In keeping with these objects and with others which will become apparent hereinafter, one feature of the present invention resides, briefly stated, in a hydraulic control device of the above mentioned type in which a hydraulic body is mounted on a widened end part of a camshaft on which a driving toothed wheel sits, a radial piston part receiving pistons is arranged in the hydraulic body with external spherical caps of the pistons sliding at an inner circumference of a ball bearing arranged eccentrically to the axis of the camshaft, and pressure medium connections lead to a cylinder space in the hydraulic body from a compression space of a piston bore hole via outlet valves, while a double-action piston is arranged in the cylinder space and has a pressure limiting valve producing a duct connection from an annular pressure space on one side of the piston to a large pressure space on the other side of the piston, so that the double-action piston continuously contacts the couple member.

When the hydraulic control device is designed in accordance with the present invention, it has the advantage over the prior art that it has a very compact construction and is very easy to install in an internal combustion engine or its engine compartment.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
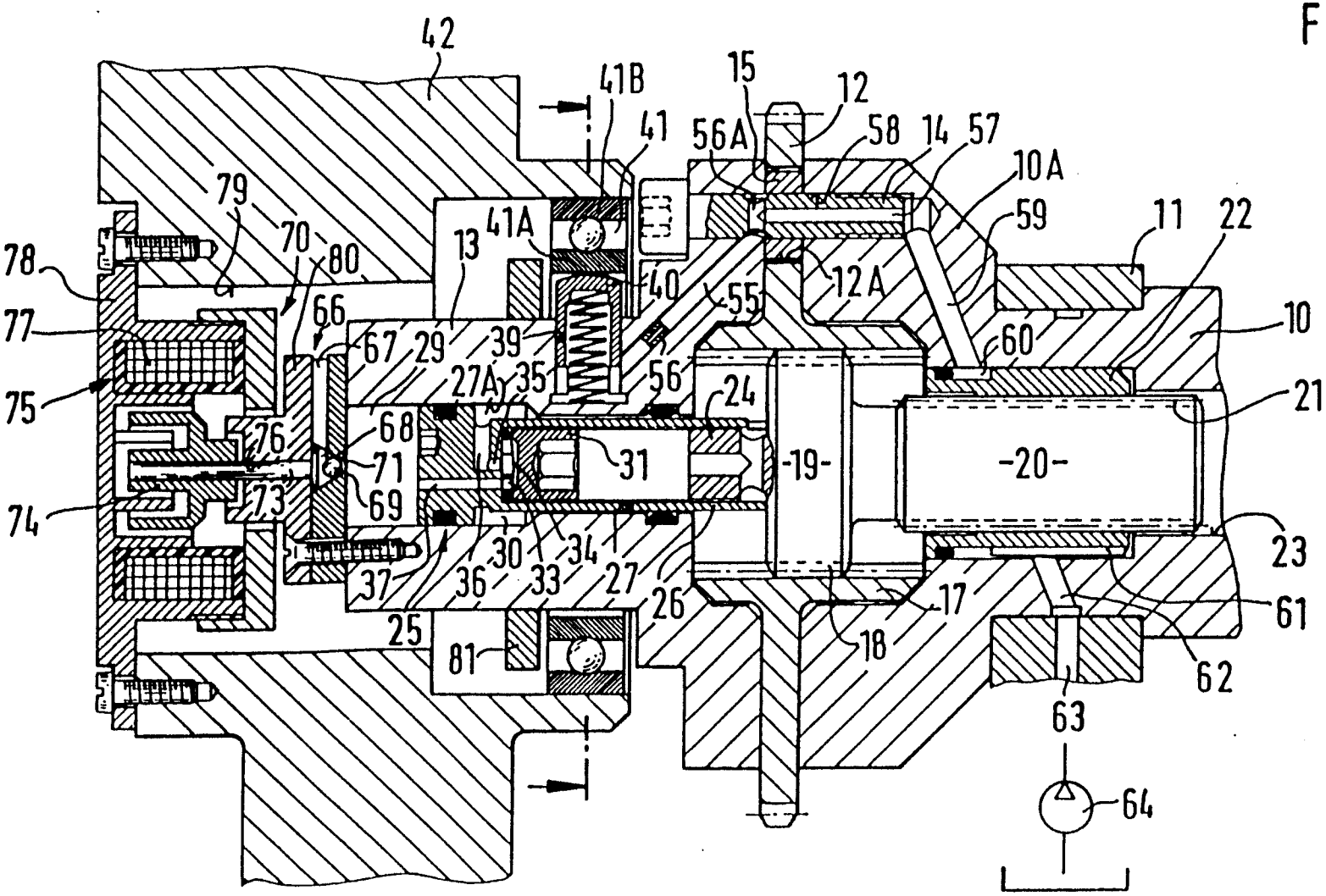
FIG. 1 shows a longitudinal section of a hydraulic control device for the rotation of the camshaft of an internal combustion region.

In FIG. 1, one end of a camshaft 10 which is supported in a camshaft bearing block 11 is designated by 10A. The camshaft is driven by a driving toothed wheel 12 to which is connected a hydraulic housing 13. The latter, as well as the toothed wheel 12 and the camshaft 10 are connected so as to be movable through a rotational angle by screws 14 and sleeves 15, specifically in that the sleeves 15 are arranged with play in curved slots 12A of the driving toothed wheel 12. Only one screw and one sleeve are shown in FIG. 1. The screws will be described in greater detail below.

The driving toothed wheel 12 has a hub 17. A helical or spiral toothing or set of gear teeth 18 is constructed at the bore hole of the hub 17. An identical toothing of a couple member 19 engages with the spiral toothing 18. The couple member 19 has a continuation 20 which is reduced in diameter and has a straight toothing 21 at the outer circumference. The straight toothing 21 engages with an identical toothing at a sleeve 22 which is arranged so as to be fixed in a central, continuous longitudinal bore hole 33 of the camshaft 10. In this way, the camshaft 10 rotates relative to the toothed wheel 12 when the couple member 19 is displaced.

A short continuation 24 is constructed at the couple member 19 concentrically opposite the continuation 20. A double-action piston 25 is screwed to this continuation 24 by its piston rod 26 which dips into a central stepped bore hole 27 of the hydraulic body 13. The piston 25 slides in the widened part 27A of the stepped bore hole 27. It divides the bore hole step 27A into two pressure spaces 29 and 30. An insert 31 is screwed into the piston rod 26, a pressure limiting valve 33 being arranged between the insert 31 and the base of the piston 25. This pressure limiting valve 33 has a diaphragm-shaped valve body 34 cooperating with a central bore hole 35 which is constructed in the piston and is connected with a transverse bore hole 36 opening into the pressure space 30. A longitudinal bore hole 37 which extends from the pressure space 29 to the pressure limiting valve 33 penetrates the piston 25 so as to be offset relative to the bore hole 35. When the diaphragm 34 contacts its seat, it separates the two bore holes 35 and 37 from one another.

A radial piston pump 38 is arranged in the hydraulic body 13 at the height of the piston rod 26 and has a plurality of radially extending pocket holes 39. Pistons 40 which contact the inner ring 41A of a ball bearing 41 with their external rounded caps slide in these pocket holes 39. The ball bearing 41 is supported by its outer ring 41B in the cylinder head cover 42 of the internal combustion engine. The ball bearing 41 is arranged eccentrically relative to the longitudinal axis of the pistons 25 so that the latter execute a lifting movement when the hydraulic body 13 rotates. The quantity of pocket holes 39 corresponds to the number of screws 14 and they are located in the same plane.

Figure 2:
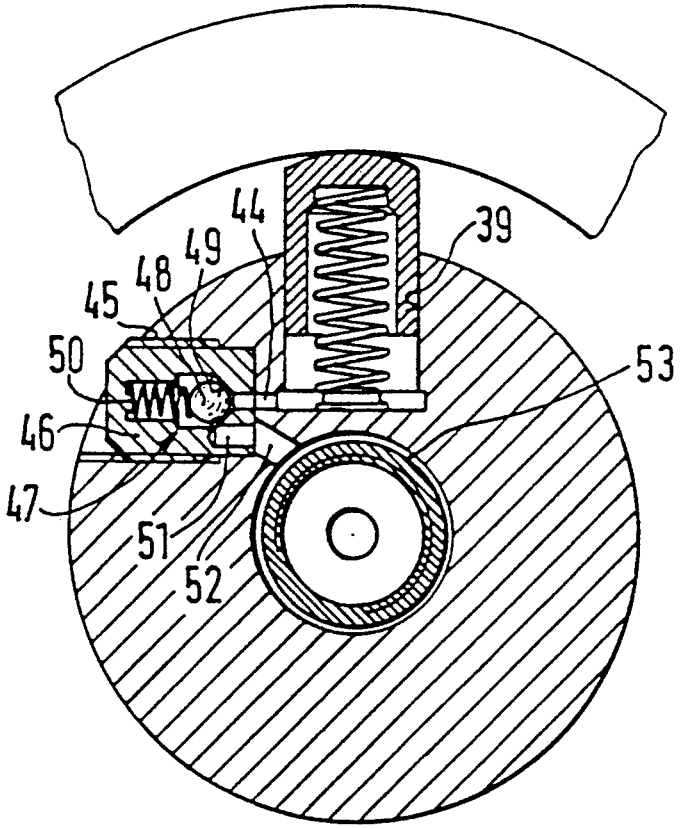
FIG. 2 shows a section along II—II according to FIG. 1.

As shown in FIG. 2, a short, transversely extending bore hole 44 leads from the base of every pocket hole 39 to a bore hole 45 with a much greater diameter, in which is arranged an insert 46 which receives an outlet valve 47. The latter has a spherical valve body 48 which lies on a conical valve seat 49 under the influence of a pressure spring 50, the bore hole 44 opening into this valve seat 49. A parallel bore hole 51 in the insert proceeds from a location adjacent to the bore hole 44. A bore hole 52 which leads to an annular gap 53 communicating with the pressure space 30 opens into this bore hole 51. Thus it can be seen that when the valve body 48 is lifted from its seat, a connection is formed from the piston bore hole 39 and its displacement space to the pressure space 30.

A diagonal bore hole 55 which receives a throttle 56 and leads to the screw 14 opens out above the base of the pocket hole 39. The screw 14 has a continuous transverse bore hole 56A which, however, is closed. A longitudinal bore hole 57 which extensively penetrates the screw proceeds from the transverse bore hole 56A and opens into the base of the bore hole 58 receiving the screw. A diagonal bore hole 59 extends from there to an annular groove 60 at the outer circumference of the sleeve 22. A longitudinal groove 61 which extends at the outer circumference of the sleeve and communicates with a diagonal bore hole 62 extending in the camshaft opens into the annular groove, the diagonal bore hole 62 communicating in turn with a transverse bore hole 63 in the bearing 11. The bore hole 63 is connected via a line with a pre-delivery pump 64 which sucks pressure medium from a reservoir (see also FIG. 3). It can be seen from this that the pocket hole 39 receiving the pistons 40 is connected with the reservoir via the connections described above, i.e. the diagonal bore hole 55 forms the suction bore hole for the radial piston pump, while the throttle 56 forms a suction throttle for limiting pressure medium at high speeds.

The hydraulic body 13 is closed by a two-part valve housing 66 of an electromagnetic valve 70 which has a transverse bore hole 67 proceeding from the outside and opening out at a valve seat 68 for a spherical valve body 61. The valve body 69 controls a central bore hole 71 forming a connection from the pressure space 29 to the bore hole 67 when the valve body is lifted. A pin 73 which is securely arranged in the armature 74 of an electromagnet 75 can act on the valve body 69. The pin 73 penetrates a longitudinal bore hole 76 in the valve plate 66 in a sliding manner.

The construction of the electromagnet will be discussed only briefly. It has a coil 77 arranged in a cover 78 which closes a bore hole 79 in the cylinder head cover 42. The end part of the hydraulic body 13 also penetrates into this bore hole 79. The pin 73 is produced from nonmagnetic material, the magnet core 80 is produced from soft magnetic material. As a result of its special construction, the magnet core 80 is so fashioned as to constitute a proportional pressure limiting valve.

A sensor ring 81 which simultaneously secures the ball bearing 41 against displacement is arranged at the outer circumference of the valve body 13. The sensor ring 81 determines the speed of the camshaft and transmits a speed signal to an electronic control device which controls the electromagnetic valve 75 according to determined criteria.

When the proportional pressure limiting valve 75 is not supplied with current, the armature 74 and the pin 73 move to the left as a result of the pressure in the pressure space 29 so that the valve body 69 opens the passage from the pressure space 29 to the environment, e.g. the pressure medium reservoir, via the bore holes 71 and 67.

When the driving toothed wheel 12 rotates along with the camshaft 10 and cylinder body 13, the pistons 40 execute a stroke movement and suck pressure medium out of the pressure medium reservoir via the diagonal bore holes 55 and the above-described connection. During an inward stroke, the pressure medium is displaced via the outlet valves 47 into the annular gap 53 and into the pressure space 30. The piston 25 is now moved to the left by the pressure prevailing in this pressure space, whereupon the couple member 19, with its toothing, imparts a rotating movement to the camshaft 10 relative to the driving toothed wheel 12. It now occupies a first position. The pressure medium required for the suction by the pistons 40 is fed via the pre-delivery pump 64.

When the electromagnet 75 is excited, the valve body 69 is pressed on its valve seat 68 by the armature 74 and the tappet 73. This prevents the pressure medium from flowing out of the pressure space 29. A determined pressure, e.g. 30 bar, is now built up in the pressure space 30 by the pressure medium which continues to be delivered, whereupon the pressure limiting valve 33 opens by the lifting of the diaphragm 34 from its valve seat. Pressure medium can now penetrate into the pressure space 29 via the bore hole 35 and the longitudinal bore hole 37. The pressure in the pressure space 29 now likewise increases until it has reached the same value as the pressure space 30. However, since the free piston surface is substantially larger than the annular piston surface, the piston 25 moves to the right. The camshaft 10 now receives a new angular position relative to the driving toothed wheel 12 by means of the couple member 19 and its toothing. This is made possible in that the sleeves 15 are movable toward both sides in the longitudinal slots of the driving toothed wheel with reference to the circumference of the driving toothed wheel. The suction throttle 56 defines the flow to the piston bore holes 39.

Intermediate positions of the couple member 19 and accordingly of the camshaft 10 are achieved by partial excitation of the proportional pressure limiting valve 75. In so doing, the hydraulic forces acting toward the right are in equilibrium with the force acting toward the left which results from the driven sprocket wheel 12 via the toothing at the couple member.

The electromagnet 75 will be addressed briefly once again. During the rotation of the camshaft 10 and the armature 74 in the excited electromagnet, eddy currents are induced in the armature which in turn exert a moment on the armature directed opposite to the rotation. The suspension of the armature 74 at the pin 73 and the transmission of force to the valve body 69 allow a rotation of the armature and magnet core. The rotating pin 73 has almost no frictional force during axial movement. The proportional pressure limiting valve accordingly has low hysteresis so that the pressure in the pressure space 29 can be adjusted very precisely.

It will be understood that each of the elements described above, or two or more together, may also find a useful application in other types of constructions differing from the types described above.

While the invention has been illustrated and described as embodied in a hydraulic control device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic control device for rotating a camshaft of an internal combustion engine relative to a crankshaft, comprising a coupling member which is longitudinally displaceable by a fluid pressure and has an outer circumference with a first set of gear teeth provided at a first location and engageable with an inner set of gear teeth of the camshaft, and a second set of gear teeth provided at a second location of the outer circumference of the coupling member; a hollow cylindrical driving wheel supporting an end of said coupling member and having a central bore hole provided with a set of gear teeth engaging with said second set of gear teeth of said coupling member, so that two sets of gear teeth are formed, one of said sets of gear teeth being a spiral set of gear teeth and the other of said sets of gear teeth being a straight set of gear teeth, so that the camshaft is rotated relative to said driving wheel by a displacement of said coupling member; at least one piston acted upon by a pressure fluid and arranged in a hydraulic housing mountable on the camshaft and having at least one radial bore hole which receives said at least one piston; said hydraulic housing having a cylinder space; a ball bearing arranged eccentrically relative to an axis of the cam shaft so that said at least one piston slides at an inner circumference of said ball bearing; a plurality of fluid connections leading to said cylinder space in said hydraulic housing from a respective compression space of said at least one bore hole, said fluid connection being provided with at least one outlet valve; a double-acting piston arranged in said cylinder space and having a pressure limiting valve producing a fluid connection from an annular pressure space situated on one side of said double-acting piston to a large pressure space situated on the other side of said double-acting piston, said double-acting piston continuously contacting said coupling member.

2. A device as defined in claim 1: and further comprising a valve housing which seals said cylinder space receiving said double-acting piston; and an electromagnetically actuated valve controlling a fluid pressure in said large pressure space.

3. A device as defined in claim 1: wherein an electromagnetically actuated valve comprises an electromagnet with a magnetic flux guided formed as a plate, an armature, a valve body, and a pin which acts on said valve body and is arranged in said armature of said electromagnet.

4. A device as defined in claim 1: and further comprising at least one screw connecting the camshaft, said driving wheel and said hydraulic housing, said at least one screw having pressure fluid ducts connected with a pressure fluid reservoir and with said at least one bore hole.

5. A device as defined in claim 4: and further comprising means forming further ducts which communicate said pressure fluid ducts with said pressure fluid reservoir, and means forming additional ducts which communicate said pressure fluid ducts with said bore holes, said additional ducts being provided with a throttle.

6. A device as defined in claim 1, wherein one of said at least one outlet valve is connected to a pressure side of a respective one of said at least one bore hole which in turn is connectable to said annular pressure space of said double-acting piston.

7. A device as defined in claim 4, wherein said driving wheel has curved slots; and further comprising sleeves arranged in said curved slots, said screws extending through said sleeves.

8. A device as defined in claim 1, wherein said driving wheel is a hollow cylindrical sprocket wheel.

* * * * *